US009467778B2

(12) United States Patent
Swanson et al.

(10) Patent No.: US 9,467,778 B2
(45) Date of Patent: Oct. 11, 2016

(54) BEAMFORMING A DIGITAL MICROPHONE ARRAY ON A COMMON PLATFORM

(71) Applicant: Cirrus Logic, Inc., Austin, TX (US)

(72) Inventors: Eric J. Swanson, Buda, TX (US); Ed Schneider, Austin, TX (US)

(73) Assignee: CIRRUS LOGIC, INC., Austin, TX (US)

( * ) Notice: Subject to any disclaimer, the term of this patent is extended or adjusted under 35 U.S.C. 154(b) by 478 days.

(21) Appl. No.: 13/844,802

(22) Filed: Mar. 16, 2013

(65) Prior Publication Data

US 2014/0270247 A1 Sep. 18, 2014

Related U.S. Application Data

(63) Continuation of application No. 13/844,744, filed on Mar. 15, 2013.

(51) Int. Cl.
*H04R 3/00* (2006.01)

(52) U.S. Cl.
CPC ..... *H04R 3/005* (2013.01)

(58) Field of Classification Search
None
See application file for complete search history.

(56) References Cited

U.S. PATENT DOCUMENTS

| | | | | |
|---|---|---|---|---|
| 4,907,222 | A * | 3/1990 | Slavik | H04J 3/06 307/10.1 |
| 5,381,460 | A * | 1/1995 | Ohashi et al. | 455/569.1 |
| 5,600,317 | A | 2/1997 | Knoth et al. | |
| 5,714,956 | A | 2/1998 | Jahne et al. | |
| 6,271,780 | B1 | 8/2001 | Gong et al. | |
| 8,175,291 | B2 * | 5/2012 | Chan et al. | 381/94.7 |
| 2006/0178169 | A1 * | 8/2006 | Dunn, Jr. | H04M 1/6091 455/569.2 |
| 2009/0058519 | A1 * | 3/2009 | Nishimura | 330/85 |
| 2014/0098980 | A1 * | 4/2014 | Kaetel | 381/300 |

OTHER PUBLICATIONS

Jiande Wu, Shen Zong, Xiangning He, "Power/Signal Time Division Multiplexing Technique based on Power Electronic circuits", Mar. 6-11, 2011, Applied Power Electronics Conference and Exposition (APEC), 2011 Twenty-Sixth Annual IEEE, pp. 1710-1714.*

LVDS Owner's Manual, Texas Instruments, 2008, www.ti.com/lvds, Dallas, Texas.

Olson, Harry F., Directional Microphones, Journal of the Audio Engineering Society, RCE Laboratories, Princeton, New Jersey, Oct. 1967, vol. 14, No. 4, pp. 190-194.

Gabrielson, Thomas B., Mechanical-Thermal Noise in Micromachined Acoustic and Vibration Sensors, IEEE Transactions on Electron Devices, May 1993, vol. 40, No. 5, pp. 903-909.

* cited by examiner

*Primary Examiner* — Curtis Kuntz
*Assistant Examiner* — Kenny Truong
(74) *Attorney, Agent, or Firm* — Norton Rose Fulbright US LLP

(57) ABSTRACT

An interface for an array of digital microphones in an electronic device may include a head-end chip coupled to the digital microphones through a bus. The bus may be shared by each microphone of the array of microphones and be multiplexed to allow transmission of data from the microphones to the head-end chip and transmission of power from the head-end chip to the array of digital microphones. The head-end chip may perform signal processing on receive data from the array of digital microphones to create beamforming arrays. The array of microphones may include microphones with different characteristics to improve performance of the array of microphones.

17 Claims, 5 Drawing Sheets

BEAMFORMING A DIGITAL MICROPHONE ARRAY ON A COMMON PLATFORM

CROSS-REFERENCE TO RELATED APPLICATIONS

This application is a continuation of U.S. patent application Ser. No. 13/844,744 to Eric J. Swanson et al., filed Mar. 15, 2013, and entitled "Interface for a Digital Microphone Array."

FIELD OF THE DISCLOSURE

The instant disclosure relates to audio devices. More specifically, this disclosure relates to microphones.

BACKGROUND

Many electronic devices, such as mobile phones, include a microphone. The microphone may be, for example, a near-speech microphone for detecting voice conversation during a telephone call. Additional microphones may be included on an electronic device for detecting environmental sounds. For example, a reference microphone may be included in an electronic device to measure background noise provided as feedback to a noise cancelling algorithm.

Performance of conventional microphones is, at least in part, proportional to microphone area and pre-amplifier power. For example, increasing the area of a microphone by four times and increasing the pre-amp power by four times may result in a dynamic range improved by two times. However, the cost of a microphone increases rapidly with microphone area because larger microphones are more fragile and difficult to manufacture. Increasing costs of microphones to obtain increased performance may not be well tolerated in certain devices, such as certain types of mobile phones. Instead, higher cost microphones are often limited to specific markets, such as audio recording.

One solution for performance issues is to implement an array of microphones to obtain better audio input. Arrays of microphones have been implemented in specific markets that are relatively cost-insensitive, such as when recording surround sound audio for movies. However, building multiple microphones into a consumer electronic device has typically been cost-prohibitive.

Conventional microphones have limitations that prevent large arrays of microphones from being constructed cost-effectively in an electronic device. For example, analog signals are incapable of traveling long distances without degradation of the analog signal. Additionally, when an array of microphones is constructed, the number of wires between the array of microphones and a head-end chip increases proportional to the number of microphones in the array. The head-end chip may be a processor, such as a digital signal processor (DSP), located between the array of microphones and other circuitry in an electronic device. That is, if each microphone has a three-wire connection, then an array of ten microphones may have a total of as many as thirty wires. A large number of wire connections complicates layout of a circuit board for interconnecting the head-end chip with the array of microphones.

Furthermore, microphones have limited noise rejection capability. For example, digital microphones (DMICs) often have noise rejection of about 20 decibels. Low noise rejection in a microphone leaves the microphone susceptible to degraded performance from a noisy power supply. Conventionally, a reference voltage in an electronic device powering the microphone has a high noise density resulting from amplifying a small proportional-to-absolute-temperature (PTAT) voltage to add to a transistor voltage drop, $V_{BE}$, to produce the reference voltage. An amplifier delivering the reference voltage may add noise as much as 100 nV/$\sqrt{\text{Hz}}$. One prior solution is to co-locate a large capacitor with each microphone to limit the bandwidth of power supply noise received at the microphone. However, high capacitance capacitors consume a large amount of circuit board space.

Shortcomings mentioned here are only representative and are included simply to highlight that a need exists for improved microphones or microphone array technology, particularly for consumer-level devices. Embodiments described here address certain shortcomings but not necessarily each and every one described here or known in the art.

SUMMARY

In one embodiment, an array of digital microphones may be cost-effectively constructed through distribution of a noise bandwidth-limited supply voltage to the array of digital microphones through low noise multiplexing. For example, a single high capacitance capacitor may be placed near a head-end chip of an array of microphones. The head-end chip may receive low-noise power filtered by the large capacitor and distribute energy to each microphone of the array of digital microphones. The distribution of energy to the array of microphones may be multiplexed with data transfer through a single bus or a low number of buses. For example, a single bus, such as a 2-wire bus or a 3-wire bus, may interconnect the array of microphones with the head-end chip. The distribution of power to the array of digital microphones, the transmission of data from the array of digital microphones to the head-end chip, and/or the transmission of control signals from the head-end chip to the array of digital microphones may be multiplexed through the bus through time division multiplexing (TDM), frequency division multiplexing (FDM), or other technologies known in the art.

The implementation of a bus for the array of digital microphones allows scaling the number of microphones in the array without a proportional increase in the cost of construction of the electronic device with the array of microphones. That is, costs due to increasing size and complexity of routing signals are reduced.

Large arrays of microphones may be constructed to improve reception of audible signals, and even perform similar to or better than large-area, high-cost conventional microphones. For example, 16 substantially identical digital microphones may be placed in an array to achieve a dynamic range four times that of a single digital microphone. Further, the signals from the digital microphones may be processed in the digital domain through beamforming to achieve a desired polar response pattern. A desired polar response pattern may focus the array of microphones on a voice, such as a speaker in a room during a conference. In another example, an array of microphones may be constructed with microphones with different characteristics to improve a range of audio signals capable of capture by the array of microphones. In one embodiment, the array of microphones may include high-Q, low-amplitude elements with low-Q, high-amplitude elements. The head-end chip may apply processing to signals received from the microphones to adjust amplitude and delay. The array of microphones may be constructed on a common platform, such as within a mobile device.

According to one embodiment, a method may include receiving data from an array of digital microphones through a shared bus. The method may also include powering the array of digital microphones through the shared bus.

The method may also include multiplexing the reception of data and the powering of the array of digital microphones through the shared bus according to a time division multiplexing (TDM) scheme, in which the TDM scheme comprises sending power from an external source to the array of digital microphones on the shared bus during a first time period, receiving data from the array of digital microphones on the shared bus during a second time period, the first time period and the second time period defining a cycle, in which the second time period is further multiplexed into portions for each digital microphones of the array of digital microphones to transmit data on the shared bus; synchronizing the digital microphones according to the TDM scheme; decoding received data from the shared bus according to a low-voltage signaling scheme operating at a voltage lower than the external source; and/or controlling the array of digital microphones through the shared bus, in which the step of controlling comprises adjusting a gain setting of each digital microphone of the array of digital microphones to perform beamforming, and/or in which the step of controlling comprises powering down at least one digital microphone of the array of digital microphones, and powering up at least one digital microphone of the array of digital microphones when a wake-on-voice signal is received.

According to another embodiment, a head-end chip may include a power control circuit coupled to an supply voltage and coupled to a shared bus, in which the power control circuit is configured to supply power to an array of digital microphones through the shared bus. The head-end chip may also include a microphone bus master circuit coupled to the shared bus, in which the microphone control circuit is configured to receive data from the array of digital microphones through the shared bus.

In certain embodiments, the power control circuit and the microphone bus master circuit are configured to access the shared bus through a time division multiplexing (TDM) scheme, in which the TDM scheme comprises the power control circuit sending power to the array of digital microphones during a first time period, the bus master circuit receiving data from the array of digital microphones on the shared bus during a second time period, the second time period and the first time period defining a cycle, in which the second time period is further multiplexed into portions for each digital microphone of the array of digital microphones to transmit data on the shared bus; the microphone bus master circuit is configured to generate a synchronization signal for coordinating the array of digital microphones according to the TDM scheme; the received data is decoded by the bus master circuit according to a low-voltage signaling scheme operating at a voltage lower than the supply voltage; and/or the microphone bus master circuit comprises a microphone control circuit, in which the microphone control circuit is configured to adjust a gain setting of each digital microphone of the array of digital microphones to perform beamforming, and/or in which the microphone control circuit is configured to power down at least one digital microphone of the array of digital microphones and power up at least one digital microphone of the array of digital microphones when a wake-on-voice signal is received.

According to yet another embodiment, an apparatus may include a bus, an array of digital microphones coupled to the shared bus, and a power supply coupled to the shared bus for powering the array of digital microphones, wherein the power supply is multiplexed on the shared bus.

In certain embodiments, the bus comprises two wires; the power supply is multiplexed on the shared bus with data from the array of digital microphones; each digital microphone of the array of digital microphones is configured to communicate through the two wires according to a low voltage differential signaling (LVDS) scheme; and/or the power supply comprises a first capacitor, and each digital microphone of the array of digital microphones comprises a second capacitor, in which the second capacitors have a smaller capacitance than the first capacitor.

According to one embodiment, an apparatus may include a common platform. The apparatus may also include an array of digital microphones built on the common platform. The array having a first subset of digital microphones having a first characteristic and a second subset of digital microphones having a second characteristic, in which the second subset of digital microphones have a different characteristic than the first subset of digital microphones. The apparatus may also include a processor configured to combine a plurality of outputs from the array of digital microphones and to beamform the plurality of outputs from the array of digital microphones.

In certain embodiments, the characteristic may be at least one of Q-factor, sensitivity, and amplitude, such as when the first subset of digital microphones include microphones with a high Q-factor and a low amplitude, and in which the second subset of digital microphones include microphones with a low Q-factor and a high amplitude.

The processor may also be configured to disable the second subset of digital microphones when the second subset of digital microphones are saturated; to beamform the array of digital microphones; to adjust at least one of a gain and a phase of the plurality of outputs from the array of digital microphones; to provide power to the array of digital microphones; to receive data from the array of digital microphones; and/or time division multiplex providing power and receiving data over the shared bus.

According to another embodiment, a method may include receiving data from a first array of digital microphones on a common platform. The method may also include receiving data from a second array of digital microphones on the common platform, the digital microphones of the second array having a different characteristic than digital microphones of the first array. The method may further include combining the received data to form an audio signal. The method may also include beamforming the first array and the second array of digital microphones.

In certain embodiments, the method may also include receiving data from a second array of digital microphones on the common platform, the digital microphones of the second array having a different characteristic than digital microphones of the first array, in which the characteristic comprises at least one of Q-factor, sensitivity, and amplitude, such as when the first array of digital microphones includes microphones with a high Q-factor and a low amplitude, and in which the second array of digital microphones includes microphones with a low Q-factor and a high amplitude.

The method may also include detecting microphones of the second array of digital microphones are saturated, based at least in part, on detecting a clipping condition at an output of the microphone; disabling the second array of digital microphones when the second array of digital microphones clip are saturated; beamforming the first array of digital microphones; adjusting at least one of a gain and a phase of the first array and the second array of digital microphones;

powering the first array of digital microphones through a shared bus; receiving data from the first array of digital microphones through the shared bus; and/or multiplexing receiving data and providing power through the shared bus.

According to yet another embodiment, a computer program product may include a non-transitory computer readable medium including code for performing the steps including receiving data from a first array of digital microphones on a common platform, receiving data from a second array of digital microphones on the common platform, the second array of digital microphones having a different characteristic than the first array of digital microphones, combining data from the first array and the second array of digital microphones, and beamforming the first array and the second of digital microphones.

In certain embodiments, the medium may also include code for performing the step of detecting microphones of the second array of digital microphones are saturated, based at least in part, on detecting a clipping condition in the received data from the second array of microphones; disabling the second array of digital microphones when the second array of digital microphones clip are saturated; adjusting a delay of a microphone of the first array of digital microphones; adjusting a gain of a microphone of the first array of digital microphones; beamforming the first array and the second array of digital microphones to focus on a voice; transferring data to the first array of digital microphones over a shared bus; transferring energy to the first array of digital microphones over the shared bus; and/or time division multiplexing receiving data and transferring energy to the first array and the second array of digital microphones over the shared bus.

The foregoing has outlined rather broadly certain features and technical advantages of embodiments of the present invention in order that the detailed description that follows may be better understood. Additional features and advantages will be described hereinafter that form the subject of the claims of the invention. It should be appreciated by those having ordinary skill in the art that the specific embodiments disclosed may be readily utilized as a basis for modifying or designing other structures for carrying out the same or similar purposes. It should also be realized that such equivalent constructions do not depart from the spirit and scope of the invention as set forth in the appended claims. The novel features that are believed to be characteristic of the invention, both as to its organization and method of operation, together with further objects and advantages will be better understood from the following description when considered in connection with the accompanying figures. It is to be expressly understood, however, that each of the figures is provided for the purpose of illustration and description only and is not intended as a definition of the limits of the present invention.

BRIEF DESCRIPTION OF THE DRAWINGS

For a more complete understanding of the disclosed system and methods, reference is now made to the following descriptions taken in conjunction with the accompanying drawings.

DETAILED DESCRIPTION

Figure 1:
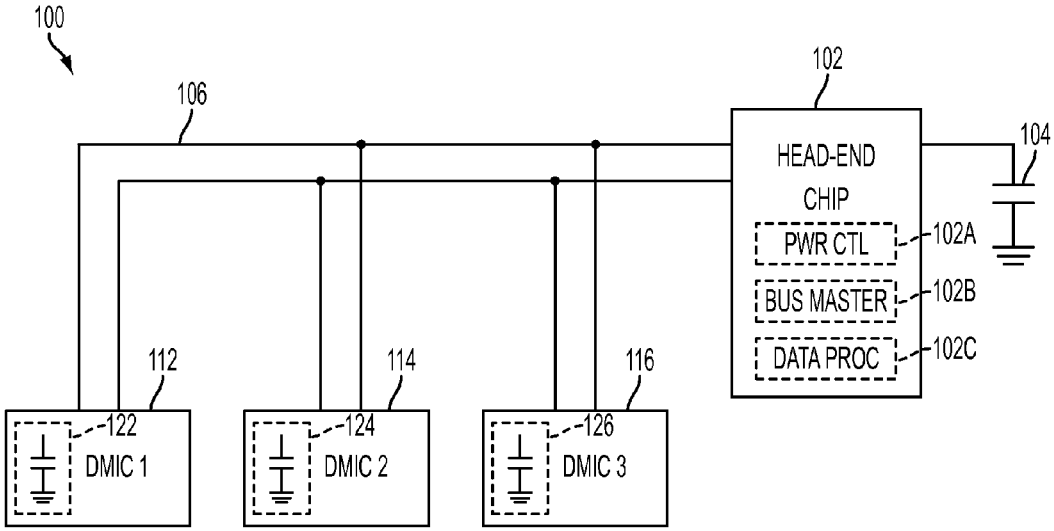
FIG. 1 is a block diagram illustrating an interface for an array of microphones according to one embodiment of the disclosure.

FIG. 1 is a block diagram illustrating an interface for an array of microphones according to one embodiment of the disclosure. A system 100 may include a head-end chip 102 coupled to a shared bus 106. The bus 106 may be, for example, a 2-wire or 3-wire twisted-pair bus. An array of digital microphones (DMICs), including DMIC 112, DMIC 114, and DMIC 116, may be coupled to the bus 106 and in communication with the head-end chip 102. The head-end chip 102 may be coupled to a power supply through a capacitor 104 and/or other device for receiving low-noise power. Although three DMICs 112, 114 and 116 are shown, it will be understood that any number of DMICs may be used without departing from the embodiment. It will also be understood that one or more additional buses may be employed in other embodiments for various purposes.

The head-end chip 102 may perform several functions for the system 100. For example, the head-end chip 102 may include a module 102A for controlling power. The power control module 102A may couple the output of the capacitor 104 to the bus 106 to provide power to the DMICs 112, 114, and 116. The power control module 102A may also perform conditioning of the power before transferring energy onto the bus 106. The head-end chip 102 may also include a module 102B for mastering the bus 106. The bus master module 102B may control multiplexing of the bus 106 between data transfer, control signaling, and power transfer. The head-end chip 102 may further include a module 102C for data processing. The data processing module 102C may receive data from the DMICs 112, 114, and 116 and process the data, such as by adjusting gain and phase of data from the DMICs 112, 114, and 116 to beamform the array of microphones. Additional details regarding beamforming may be found in U.S. Pat. No. 5,651,071, which is hereby incorporated by reference in its entirety.

Each of the DMICs 112, 114, and 116, may include a local capacitor 122, 124, and 126, respectively. The local capacitors 122, 124, and 126 may provide stored power to operate the DMICs 112, 114, and 116. For example, power may be provided to the DMICs 112, 114, and 116, through the bus 106 during a first period of time. During a second period of time, during which no power is provided to the DMICs 112, 114, and 116, the DMICs 112, 114, and 116 may operate from energy stored in the local capacitors 122, 124, and 126, respectively. Energy transfer between the head-end chip 102 and the local capacitors 122, 124, and 126 may be controlled by the power control module 102A. Delivery of the energy over the bus 106 may be controlled by the bus master module 102B.

In one embodiment, the local capacitors 122, 124, and 126 may have a smaller capacitance than the capacitor 104. The local capacitors 122, 124, and 126 may be integrated into a single package with the DMICs 112, 114, and 116. Conventionally, large capacitors, such as ten microfarad capacitors, are placed with each digital microphone to provide a low-noise power supply. Placing a smaller capacitor, such as a one microfarad capacitor, a 0.1 microfarad capacitor, or smaller, at each digital microphone may allow construction of larger arrays of digital microphones by reducing cost and size of the system 100. The local capacitors 122, 124, and 126, may provide power to the DMICs 112, 114, and 116, respectively. A local source of power for the DMICs 112, 114, and 116 reduces the number of connections to the DMICs 112, 114, and 116 by at least two connections because there does not need to be a separate positive and negative power supply connection to the DMICs 112, 114, and 116. The local capacitors 122, 124, and 126 may be charged from the capacitor 104 during a charge cycle through the bus 106. The capacitor 104 provides a low-noise power supply to each of the DMICs 112, 114, and 116, such that each of the DMICs 112, 114, and 116 benefits from placement of a large capacitance capacitor with the head-end chip 102.

The array of digital microphones of the system 100 of FIG. 1 may have a low construction cost due, in part, to the sharing of the bus 106. In comparison, connecting each DMIC 112, 114, and 116 to a head-end chip and a power supply through separate wires would increase the complexity of design of the system 100, increase the area consumed by the system 100, and increase the cost of manufacturing the system 100.

Figure 2:
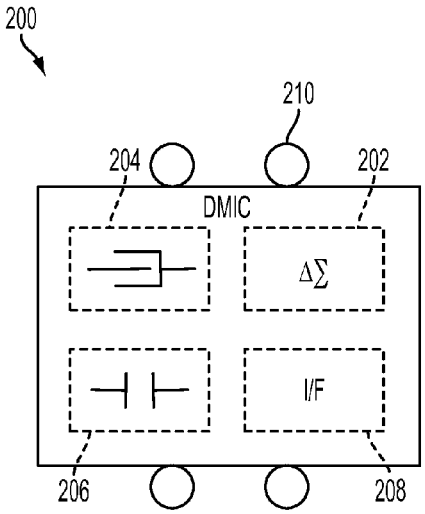
FIG. 2 is a block diagram illustrating a digital microphone with an integrated transducer according to one embodiment of the disclosure.

A packaged digital microphone for use in an array of digital microphones such as the system 100 of FIG. 1 is shown in FIG. 2. FIG. 2 is a block diagram illustrating a digital microphone with an integrated transducer according to one embodiment of the disclosure. A digital microphone (DMIC) 200 may include a packaging interface 210, such as a ball grid array (BGA). The packaging interface 210 couples internal components of the DMIC 200 with external components. The DMIC 200 may include internal components, such as a delta-sigma modulator 202, an integrated microelectromechanical system (MEMS) transducer 204, a local capacitor 206, and/or an interface 208. The interface 208 may control communications between the DMIC 200 and the bus 106 through the packaging interface 210. For example, the interface 208 may receive control signals from a head-end chip for synchronizing timing of data transfer from the DMIC 200 to the bus 106. The synchronization signal may include, for example, a heartbeat message transmitted at a similar time during a repeating cycle. At an appropriate time, the interface 208 may output data on the bus 106. The local capacitor 206 may store energy for operating the DMIC 200 when the DMIC 200 is disconnected from a power supply, such as during data transfer. The integrated MEMS transducer 204 may transduce audible signals into electrical signals. The delta-sigma modulator 202 may receive analog electrical signals from the MEMS transducer 204 and generate digital signals for transfer to the bus 106 by the interface 208.

Figure 3:
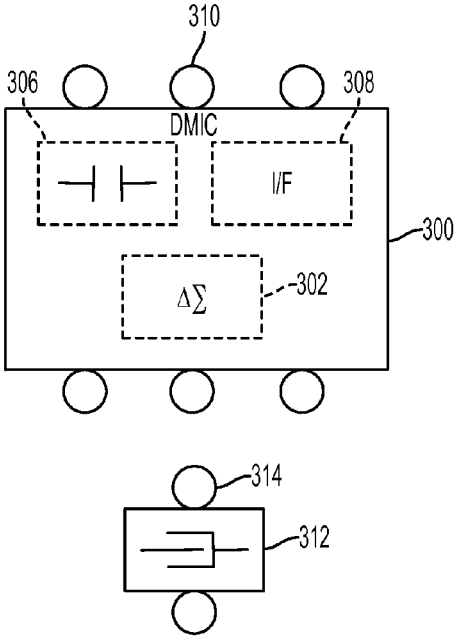
FIG. 3 is a block diagram illustrating a digital microphone with an external transducer according to one embodiment of the disclosure.

A MEMS transducer 204 is shown integrated with a digital microphone in FIG. 2. However, the MEMS transducer may be separately packaged as shown in FIG. 3. FIG. 3 is a block diagram illustrating a digital microphone with an external transducer according to one embodiment of the disclosure. A DMIC 300 may include a delta-sigma modulator 302, a local capacitor 306, and an interface 308. The delta-sigma modulator 302 may receive input signals from a MEMS transducer 312 through a packaging interface 310 of the DMIC 300 and a packaging interface 314 of the MEMS transducer 312.

The size of a DMIC, such as that illustrated in FIG. 2 or FIG. 3, may be as small or smaller than one square millimeter. The DMICs may be manufactured with wafer-level chip scale packaging. The small size of the DMICs allows an array of DMICs to be manufactured on a common platform, such as in a mouthpiece of a mobile device, at little additional cost over placement of a single DMIC on the mobile device. The array of DMICs may be configured to improve audio quality by combining microphones of different characteristics and/or performing beamforming with the array of DMICs.

Figure 4:
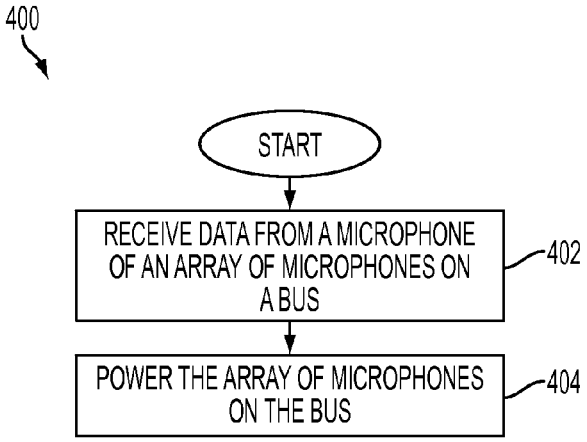
FIG. 4 is a flow chart illustrating a method of multiplexing data and power on a shared bus for an array of digital microphones according to one embodiment of the disclosure.

The bus 106 of FIG. 1 may be connected to the packaging interface 210 of the DMIC 200 in FIG. 2 or the packaging interface 310 of the DMIC 300 in FIG. 3. The bus 106 may be multiplexed to allow sharing of the bus for transfer of energy to the DMICs, transfer of data to the head-end chip, and/or transmission of control signals to the DMICs. FIG. 4 is a flow chart illustrating a method of multiplexing data and power on a bus for an array of digital microphones according to one embodiment of the disclosure. A method 400 begins at block 402 with receiving data from a microphone of an array of microphones through a bus. At block 404, energy is transferred to the array of microphones through the bus.

Control signals may also be transmitted to the DMICs or combined with the data transmission or energy transmission. The control signals may include a synchronization signal, such as a time clock, a DMIC control signal, such as to adjust a gain of a DMIC, and/or a power-down signal, such as to power down certain DMICs. For example, a head-end chip may power down all but one DMIC until a wake signal (e.g., a wake-on-voice signal) is received, indicating a user is in need of the array or is providing a voice command, at which time the head-end chip may power-up additional DMICs for receiving the voice command. In one embodiment, a third wire of the bus 106 may carry control signals between the head-end chip and the DMICs. Additional wires may be added to the bus 106 to carry other signals, such as an always-available low-noise power source.

The energy transfer and the data transfer may be multiplexed on the bus, such as through frequency multiplexing or time multiplexing. In one embodiment, an energy transfer phase may be frequency hopped on the bus along with a data transfer phase. The frequency hopping may be randomized but known in advance to the DMICs coupled to the bus. In another embodiment, an energy transfer phase may be time multiplexed on the bus along with a data transfer phase as illustrated in FIG. 5.

Figure 5:
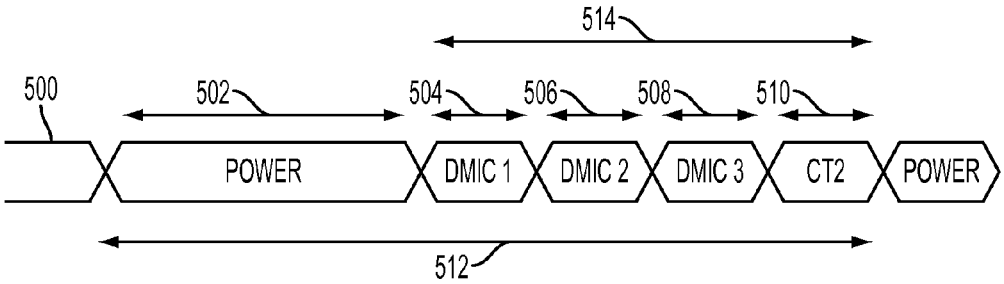
FIG. 5 is a timing diagram illustrating a method of time multiplexing data and power on a shared bus for an array of digital microphones according to one embodiment of the disclosure.

FIG. 5 is a timing diagram illustrating a method of time multiplexing data and power on a bus for an array of digital microphones according to one embodiment of the disclosure. A bus 500 may be time multiplexed into an energy transfer portion 502 and a data transfer portion 514. The energy transfer portion 502 and the data transfer portion 514 comprises a cycle 512 of the bus 500 that repeats. In one embodiment, the cycle 512 may span 333 nanoseconds to match a 3 MHz sampling frequency of the DMICs.

The data transfer portion 514 may be further multiplexed into portions for data transfer between the head-end chip and each DMIC and a portion for transfer of control signals from the head-end chip to the DMICs. For example, the data transfer portion 514 may include a first portion 504 for transferring data from a first DMIC, a second portion 506 for transferring data from a second DMIC, and a third portion 508 for transferring data from a third DMIC. Although only transfers for three DMICs are illustrated, if additional DMICs are present in the array of microphones the data transfer portion 514 may be further subdivided. Additional DMICs may be accommodated by further dividing the portion 514 or cycling DMICs in alternating cycles 512. For example, a first cycle may multiplex portion 514 for DMICs one, two, and three, and a second cycle may multiplex portion 514 for DMICs four, five, and six. A fourth portion 510 may allow transmission of control signals from the head-end chip to the DMICs.

Figure 6:
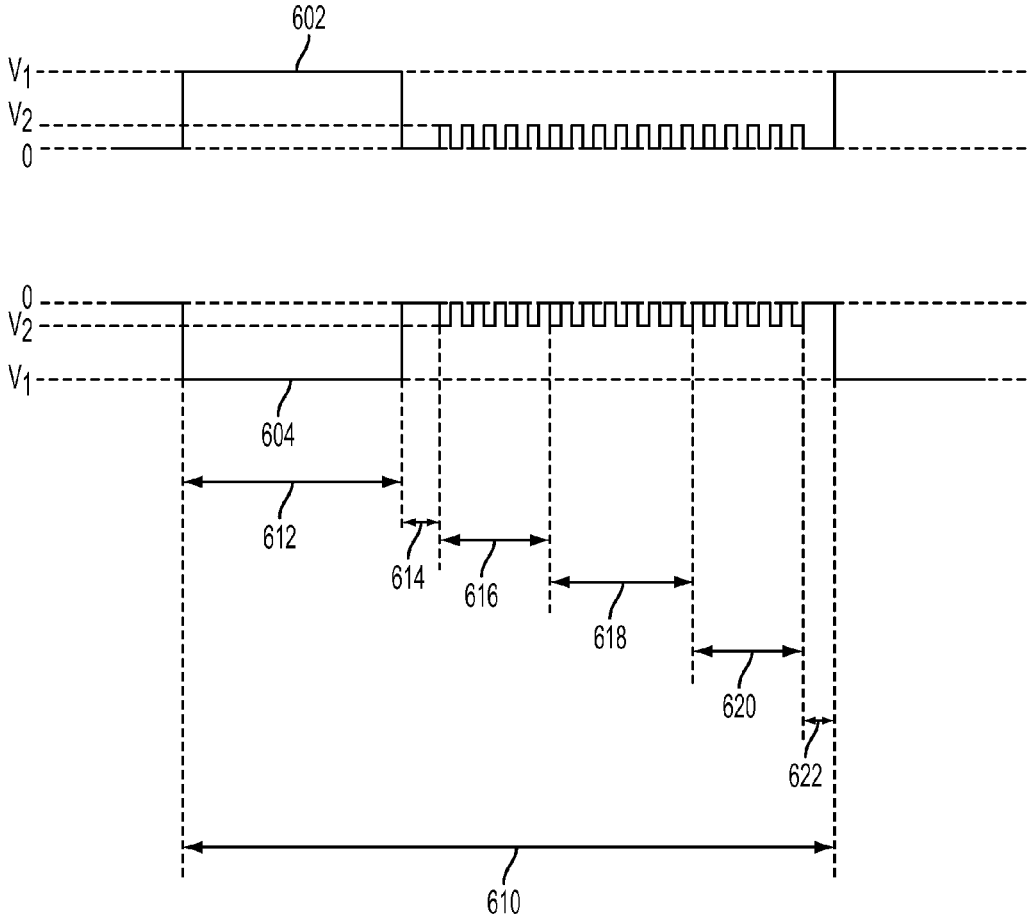
FIG. 6 is a timing diagram illustrating a method of time multiplexing data and power at different voltage levels for an array of digital microphones according to one embodiment of the disclosure.

Data may be signaled on the bus during the data transfer portion 514 according to a low voltage differential signaling (LVDS) system. LVDS signaling reduces crosstalk between DMICs that may occur when a local capacitor of a DMIC is modulated by data transfer on the bus. FIG. 6 is a timing diagram illustrating a method of time multiplexing data and power at different voltage levels for an array of digital microphones according to one embodiment of the disclosure. A first line 602 and a second line 604 of a data bus may carry differential signals. That is, data on the line 602 and the line 604 is represented by the difference between a voltage at the line 602 and the line 604. The voltages applied to the lines 602 and 604 during data transfer may be lower voltages than a voltage applied to the lines 602 and 604 during an energy transfer.

A cycle 610 includes an energy transfer portion 612 and data transfer portions 616, 618, and 620. During the energy transfer portion 612 of the cycle 610, the voltage at line 602 and line 604 may be a first voltage, $V_1$, such as a voltage greater than 2.5 Volts. During data transfer portions 616, 618, and 620, the voltage at line 602 and line 604 may be a second voltage, $V_2$, lower than the first voltage, such as a voltage lower than 2.5 Volts. Data transmitted during data transfer portions 616, 618, and 620 may be coded with a noise invariant code.

Transition portions 614 and 622 may provide a duration of time for the voltage on the lines 602 and 604 to decrease from the first voltage, $V_1$, to data transfer levels, 0 or $V_2$. Although not shown, additional portions may occur, such as a control portion described above with reference to FIG. 5.

Figure 7:
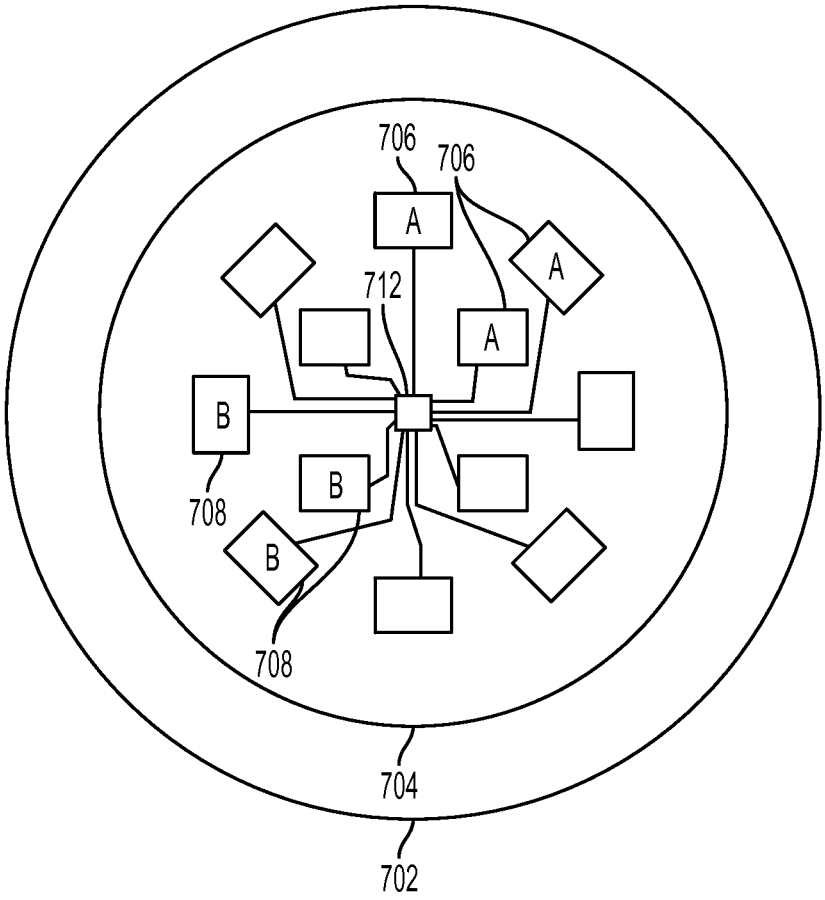
FIG. 7 is a block diagram illustrating an array of microphones built on a common platform according to one embodiment of the disclosure.

An array of microphones interfaced with a head-end chip through a shared multiplexed bus may be constructed at low cost. FIG. 7 is a block diagram illustrating an array of microphones built on a common platform according to one embodiment of the disclosure. A common platform 704 of a shell 702 may interconnect an array of microphones, including a first subset of microphones 706 and a second subset of microphones 708. The common platform 704 may be, for example, a printed circuit board interconnecting the microphones 706 and 708. The shell 702 may be, for example, a plastic casing around a mobile device.

Figure 8:
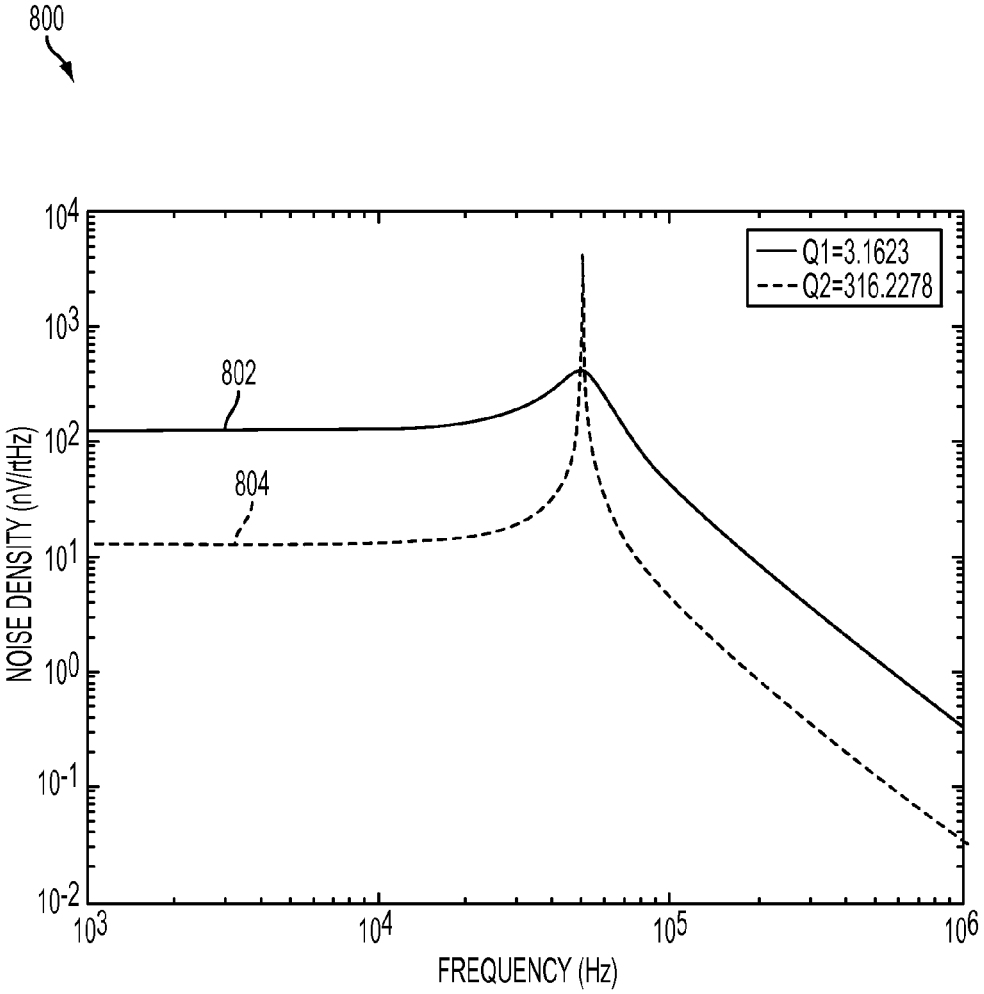
FIG. 8 is a graph illustrating a noise spectral density profiles for two microphones with different characteristics according to one embodiment of the disclosure.

The array of microphones may include different microphones with varying characteristics to improve the overall performance of the array of microphones. The first subset of microphones 706 may have a first characteristic, such as having a low Q-factor and high gain. The second subset of microphones 708 may have a second characteristic, such as having a high Q-factor and low gain. An illustration of two microphones with different characteristics is shown in FIG. 8. FIG. 8 is a graph illustrating a noise spectral density profiles for two microphones with different characteristics according to one embodiment of the disclosure. A graph 800 includes a first line 802 corresponding to a characteristic response of a first digital microphone having a Q-factor of approximately 3. A second line 804 corresponds to a characteristic response of a second digital microphone having a Q-factor of approximately 316.

Referring back to FIG. 7, microphones with different characteristics may be incorporated into an array of microphones to improve performance and dynamic range of the array of microphones. A head-end chip 712 may be coupled to the microphones 706 and 708. The head-end chip 712 may control the microphones 706 and 708 to achieve a desired characteristic. For example, the microphones 706 may experience clipping when noise levels reach a first sound pressure level, such as 60 dB, and the microphones 708 may experience clipping when noise levels reach a second sound pressure level higher than the first, such as 80 dB. When the head-end chip 712 detects the sound levels are exceeding the first sound pressure level and causing the microphones 706 to clip, the head-end chip 712 may reduce the gain of microphones 706 or disable the microphones 706. Likewise, the microphones 706 may have lower noise than the microphones 708. When low sound levels are detected, the head-end chip 712 may decrease the gain of microphones 708 or disable the microphones 708.

If implemented in firmware and/or software, the functions described above may be stored as one or more instructions or code on a computer-readable medium. Examples include non-transitory computer-readable media encoded with a data structure and computer-readable media encoded with a computer program. Computer-readable media includes physical computer storage media. A storage medium may be any available medium that can be accessed by a computer. By way of example, and not limitation, such computer-readable media can comprise RAM, ROM, EEPROM, CD-ROM or other optical disk storage, magnetic disk storage or other magnetic storage devices, or any other medium that can be used to store desired program code in the form of instructions or data structures and that can be accessed by a computer. Disk and disc includes compact discs (CD), laser discs, optical discs, digital versatile discs (DVD), floppy disks and blu-ray discs. Generally, disks reproduce data magnetically, and discs reproduce data optically. Combinations of the above should also be included within the scope of computer-readable media.

In addition to storage on computer readable medium, instructions and/or data may be provided as signals on transmission media included in a communication apparatus. For example, a communication apparatus may include a transceiver having signals indicative of instructions and data. The instructions and data are configured to cause one or more processors to implement the functions outlined in the claims.

Although the present disclosure and certain of its advantages have been described in detail, it should be understood that various changes, substitutions and alterations can be made herein without departing from the spirit and scope of the disclosure as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the present invention, disclosure, machines, manufacture, compositions of matter, means, methods, or steps, presently existing or later to be developed that perform substantially the same function or achieve substantially the same result as the corresponding embodiments described herein may be utilized according to the present disclosure. Accordingly, the appended claims are intended to include within their scope such processes, machines, manufacture, compositions of matter, means, methods, or steps.

What is claimed is:

1. An apparatus, comprising:

a common platform;

an array of digital microphones built on the common platform and coupled to a shared bus, the array comprising a first subset of digital microphones having a first characteristic and a second subset of digital microphones having a second characteristic, the second subset of digital microphones having a different characteristic than the first subset of digital microphones; and a processor coupled to the array of digital microphones, the processor being configured to:

during a first time period, communicate a transmitted signal onto the shared bus, in which the transmitted signal powers the array of digital microphones;

during a second time period, allow data from the array of digital microphones to be received onto the shared bus;

during a third time period, allow transmission of control signals to the array of digital microphones, wherein the control signals synchronize timing of data transfer from each of the array of digital microphones during the second time period;

decode data received from the array of digital microphones according to a low-voltage signaling scheme operating at a voltage lower than the transmitted signal during the first time period;

combine a plurality of outputs from the array of digital microphones; and beamform the plurality of outputs from the array of digital microphones.

2. The apparatus of claim 1, in which the characteristic comprises at least one of Q-factor, sensitivity, and amplitude.

3. The apparatus of claim 1, the first subset of digital microphones comprising microphones with a high Q-factor and a low amplitude, and the second subset of digital microphones comprising microphones with a low Q-factor and a high amplitude.

4. The apparatus of claim 1, in which the processor is configured to disable the second subset of digital microphones when the second subset of digital microphones are saturated by transmitting a control signal during the third time period.

5. The apparatus of claim 1, in which the processor is further configured to adjust at least one of a gain and a phase of the plurality of outputs from the array of digital microphones by transmitting a control signal during the third time period.

6. The apparatus of claim 1, in which the shared bus is configured to multiplex providing power and receiving data according to time division multiplexing (TDM).

7. A method, comprising:

during a first time period, communicating a transmitted signal onto a shared bus coupled to a plurality of digital microphones, in which the transmitted signal powers the plurality of digital microphones;

during a second time period, allowing data from the plurality of digital microphones to be received onto the shared bus;

during a third time period, allowing transmission of control signals to the array of digital microphones, wherein the control signals synchronize timing of data transfer from each of the array of digital microphones during the second time period;

decoding data received from the plurality of digital microphones according to a low-voltage signaling scheme operating at a voltage lower than the transmitted signal during the first time period to obtain data from a first array of digital microphones of the plurality of digital microphones on the common platform and to obtain data from a second array of digital microphones of the plurality of digital microphones on the common platform, the digital microphones of the second array having a different characteristic than digital microphones of the first array;

combining the received data to form an audio signal; and beamforming the first array and the second array of digital microphones.

8. The method of claim 7, the characteristic comprising at least one of Q-factor, sensitivity, and amplitude.

9. The method of claim 7, the first array of digital microphones comprising microphones with a high Q-factor and a low amplitude, and the second array of digital microphones comprising microphones with a low Q-factor and a high amplitude.

10. The method of claim 7, further comprising:

detecting microphones of the second array of digital microphones are saturated based, at least in part, on detecting a clipping condition at an output of the microphones; and disabling the second array of digital microphones when the second array of digital microphones clip are saturated by transmitting a control signal during the third time period.

11. The method of claim 7, in which the step of beamforming comprises adjusting at least one of a gain and a phase of the first array and the second array of digital microphones by transmitting a control signal during the third time period.

12. The method of claim 7, further comprising time division multiplexing powering the first array and receiving data from the first array on the shared bus.

13. A computer program product, comprising:

a non-transitory computer readable medium comprising code for performing the steps comprising:

during a first time period, communicating a transmitted signal onto a shared bus, in which the transmitted signal powers the plurality of digital microphones on a common platform;

during a second time period, allowing data from the plurality of digital microphones to be received onto the shared bus;

during a third time period, allowing transmission of control signals to the array of digital microphones, wherein the control signals synchronize timing of data transfer from each of the array of digital microphones during the second time period;

decoding data received from the plurality of digital microphones according to a low-voltage signaling scheme operating at a voltage lower than the transmitted signal during the first time period to obtain data from a first array of digital microphones of the plurality of digital microphones and to obtain data from a second array of digital microphones of the plurality of digital microphones, the second array of digital microphones having a different characteristic than the first array of digital microphones;

combining data from the first array and the second array of digital microphones; and beamforming the first array and the second of digital microphones.

14. The computer program product of claim 13, the first array of digital microphones comprising microphones with a high Q-factor and a low amplitude, and the second array of digital microphones comprising microphones with a low Q-factor and a high amplitude.

15. The computer program product of claim 13, in which the medium further comprises code for performing the steps comprising:

detecting microphones of the second array of digital microphones are saturated based, at least in part, on detecting a clipping condition in the received data from the second array of microphones; and disabling the second array of digital microphones when the second array of digital microphones clip are saturated by transmitting a control signal during the third time period.

16. The computer program product of claim 13, in which the medium further comprises code for performing the steps comprising at least one of adjusting a delay of a microphone of the first array of digital microphones and adjusting a gain of a microphone of the first array of digital microphones by transmitting a control signal during the third time period.

17. The computer program product of claim 13, in which the medium further comprises code for performing the step of time division multiplexing receiving data and transferring energy to the first array and the second array of digital microphones over the shared bus.

* * * * *